US010658130B2

(12) United States Patent
Castro Maciel et al.

(10) Patent No.: US 10,658,130 B2
(45) Date of Patent: May 19, 2020

(54) ELECTROMECHANICAL ACTUATION SYSTEM FOR MOMENTARY CONTACT CONTROL SWITCHES

(71) Applicant: Schweitzer Engineering Laboratories, Inc., Pullman, WA (US)

(72) Inventors: Carlos Baltazar Castro Maciel, Soledad de Graciano Sanchez (MX); Sergio David Esquivel Álvarez, Valle de Campestre (MX); José Ramón Martinez Ramírez, San Luis Potosí (MX); Héctor Jaime Alba, San Luis Potosí (MX); Eduardo Ángel Morales Delgado, Soledad de Graciano Sanchez (MX); Marco Antonio Hidrogo Ordaz, Gomez Palacio (MX); Gerardo Rodríguez Nájera, San Nicolas de los Garza (MX)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 52 days.

(21) Appl. No.: 15/976,027

(22) Filed: May 10, 2018

(65) Prior Publication Data

US 2019/0348230 A1 Nov. 14, 2019

(51) Int. Cl.

| | |
|---|---|
| ***H01H 3/28*** | (2006.01) |
| ***H01H 3/30*** | (2006.01) |
| ***H01H 3/46*** | (2006.01) |
| ***H01H 3/04*** | (2006.01) |

(52) U.S. Cl.

CPC ..... *H01H 3/28* (2013.01); *H01H 3/04* (2013.01); *H01H 3/3005* (2013.01); *H01H 3/3047* (2013.01); *H01H 3/46* (2013.01); *H01H 2221/01* (2013.01); *H01H 2221/044* (2013.01)

(58) Field of Classification Search

CPC .. H01H 3/04; H01H 3/06; H01H 3/28; H01H 3/46; H01H 3/54; H01H 3/56; H01H 50/641; H01H 50/643; H01H 50/644

See application file for complete search history.

(56) References Cited

U.S. PATENT DOCUMENTS 3,649,793 A * 3/1972 MacLean ..... H01H 71/505 335/174
4,001,740 A * 1/1977 MacLean ..... H01H 3/28 335/73

(Continued)

FOREIGN PATENT DOCUMENTS

WO WO-2015113313 A1 * 8/2015

*Primary Examiner* — Ramon M Barrera
(74) *Attorney, Agent, or Firm* — Justin K. Flanagan; Bradley W. Schield

(57) ABSTRACT

Systems and methods are disclosed herein relating to a momentary contact switch that can be both manually and electronically actuated. In some embodiments, an electronic module can be added to a manual momentary contact switch to enable electronic control. The momentary contact switch can be transitioned between first, second, and third electrical states based on the rotation of a shaft between first, second, and third rotational positions. Rotary arms are selectively engaged by pull arms connected to a master solenoid to selectively rotate the shaft from the first rotational position to the second and third rotational positions.

23 Claims, 8 Drawing Sheets

(56) References Cited

U.S. PATENT DOCUMENTS

| | | | | | |
|---|---|---|---|---|---|
| 4,255,733 | A * | 3/1981 | MacLean | H01H 19/24 | 200/400 |
| 5,762,180 | A * | 6/1998 | Pomatto | H01H 71/68 | 200/330 |
| 6,015,958 | A * | 1/2000 | Pomatto | H01H 71/68 | 200/329 |
| 9,653,244 | B1 * | 5/2017 | Castro Maciel | H01H 50/16 | |
| 9,964,189 | B2 * | 5/2018 | Rodriguez Najera | F16H 21/44 | |
| 2010/0288610 | A1 * | 11/2010 | Krieger | H01H 1/50 | 200/327 |
| 2017/0103865 | A1 * | 4/2017 | Ji | H01H 33/28 | |

* cited by examiner

ELECTROMECHANICAL ACTUATION SYSTEM FOR MOMENTARY CONTACT CONTROL SWITCHES

TECHNICAL FIELD

This disclosure relates to control switches. More particularly, this disclosure relates to stand-alone and add-on electronic systems for remote actuation of momentary contact control switches with mechanical biases.

BRIEF DESCRIPTION OF THE DRAWINGS

The written disclosure herein describes illustrative embodiments that are non-limiting and non-exhaustive. Reference is made to certain of such illustrative embodiments that are depicted in the figures described below.

DETAILED DESCRIPTION

Figures 1A, 1B, 1C:
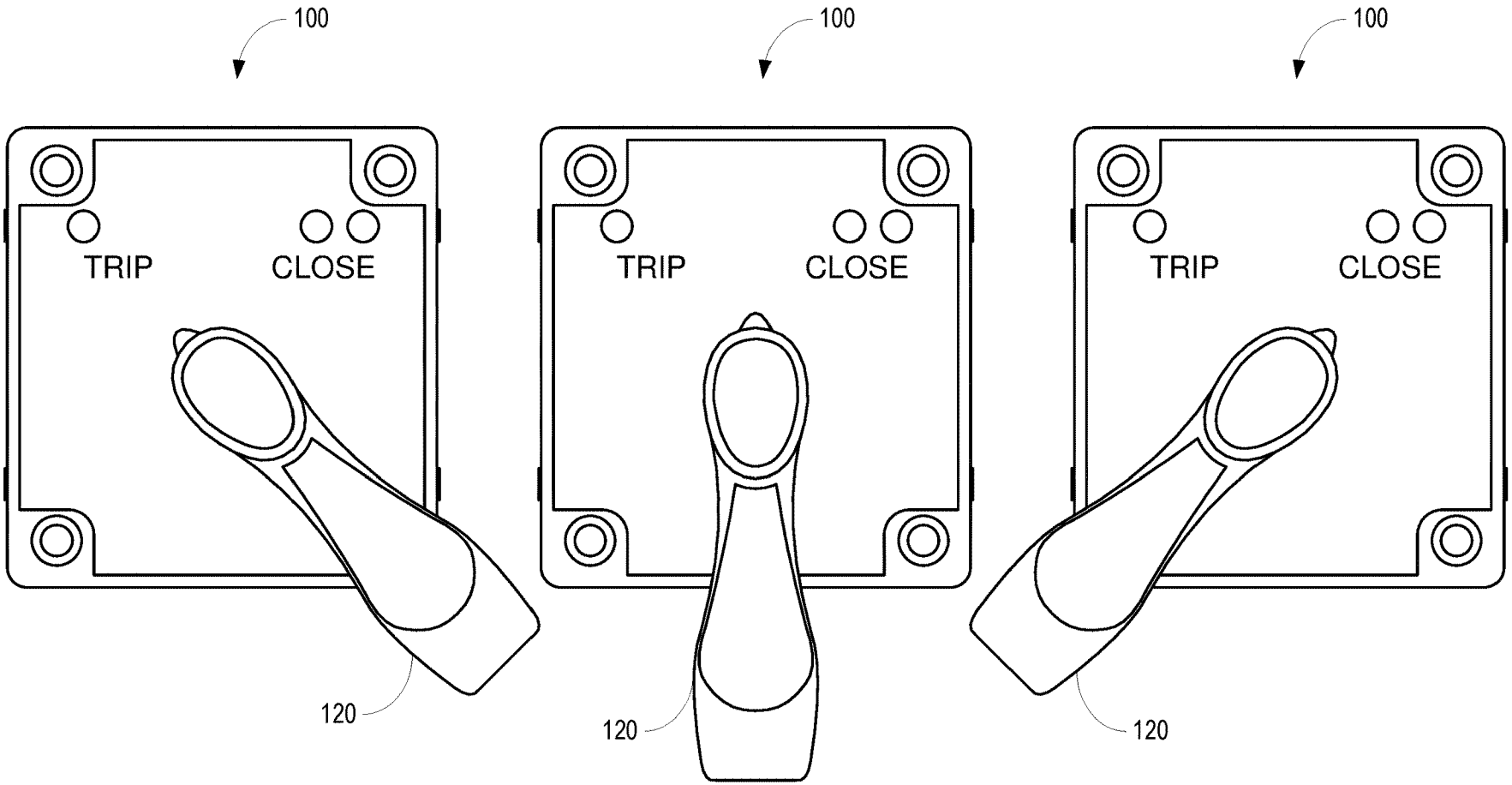
FIG. 1A illustrates an example of a momentary contact switch in a trip position.
FIG. 1B illustrates the momentary contact switch of FIG. 1A in a default, normal position.
FIG. 1C illustrates the momentary contact switch of FIG. 1A in a "close" position.

A wide variety of switches may be employed in electric power transmission and distribution systems. Momentary contact switches may be employed that have two or three positions that correspond to two or three different electrical states. In various embodiments, a momentary contact switch may have a default or "normal" position corresponding to a default or "normal" electrical state. A two-position momentary contact switch may be temporarily toggled to a second electrical state.

An example of a two-position momentary contact switch is a button switch. A default or normal state of the button switch may close electrical contacts to allow electric current to flow in a circuit. A spring-loaded button of the button switch may be manually depressed to temporarily open the electrical contacts of the circuit and prevent current flow. Once the spring-loaded button is released, a biasing spring may return the spring-loaded button to the default or normal state and the electrical contacts may be closed again. Electrically equivalent momentary contact switches may utilize any of a wide variety of physical approaches, including without limitation a knob, handle, toggle, paddle switch, biased slider, and/or a button with a deformable biasing member.

Momentary contact switches may also include multiple possible electrical states. For example, a paddle switch may have a default, middle state corresponding to a first electrical state. Toggling the paddle switch in one direction may correspond to a second electrical state, while toggling the paddle switch in the other direction may correspond to a third electrical state. In some embodiments, a rotatable handle may be biased to a center position corresponding to a default or "normal" electrical state. The rotatable handle may be rotated counterclockwise to a second electrical state or rotated clockwise to a third electrical state.

As a specific example, a momentary contact switch may be used to open or close breakers, sectionalizers, and other electrical equipment in an electric power transmission and distribution system. A switch associated with a circuit breaker in an electric power transmission and distribution system may be biased to a default position that corresponds to a normal state of the circuit breaker. A handle of the switch may be manually rotated counterclockwise to a trip position of the circuit breaker or rotated clockwise to a close position of the circuit breaker. Thus, each rotational position of the handle may correspond to a unique mechanical state of the breaker (e.g., normal, trip, and close).

In some embodiments, each rotational position of a handle (or other toggle) of the switch may correspond to unique electrical states of the switch in addition to or instead of unique mechanical states. In some embodiments, the handle or other toggle of a switch may be both manually operable and electrically operable. For example, the handle associated with a switch may be manually rotated (clockwise or counterclockwise) to cause a shaft to rotate from a default or "normal" position to either a clockwise or counterclockwise position. As previously noted, for a momentary contact switch, the shaft may be biased to return to the default or normal position once the handle is manually released. The shaft bias may directly bias the shaft or may bias the shaft via a rotational force provided by another mechanical component connected to the shaft.

In some embodiments, an electronically controlled actuator may also be capable of rotating the shaft to the clockwise and counterclockwise positions. In some embodiments, the electronically controlled actuator may electronically return the shaft to the default or normal position. In other embodiments, the shaft may be biased to return to the default or normal position as described in conjunction with the manual rotation by the handle. In various embodiments, the electronically controlled actuator may not impact or affect the manual operation of the momentary switch by the handle.

The presently-described systems and methods generally relate to a momentary contact switch with a rotatable shaft, the rotation of which allows for the selection of different mechanical states of the switch beyond the basic change in shaft position. For example, the unique mechanical states of the switch may correspond to trip, normal, and close states of a breaker. In other embodiments, the mechanical states of the switch may correspond to unique electrical states of the switch (e.g., open and closed). The present disclosure contemplates an electronically controlled actuator that can be added to an existing, manual, shaft-based momentary contact switch.

The present disclosure also contemplates a combination momentary contact switch that allows for both manual and electronic actuation by rotating a shaft between two or three rotational positions. It is appreciated that many aspects of the presently-described systems and methods could be modified for use with other types of switches, used in other applications besides electric power transmission and distribution systems, and/or modified for other electrical and even non-electrical applications in which the momentary rotation of shaft between two or more rotational positions is desirable.

In one particular embodiment, a momentary contact switch includes a shaft that is rotatable between first, second, and third rotational positions. Each of the rotational positions corresponds to a unique mechanical state of the switch. For example, in the case of a circuit breaker, the first position may correspond to a normal position of the circuit breaker. The second position may be realized by a counterclockwise rotation of the shaft and correspond to a trip position of the circuit breaker. The third position may be realized by a clockwise rotation of the shaft and correspond to a close position of the circuit breaker.

A manually operable handle may be coupled to the shaft to allow for manual rotation of the shaft between the first, second, and third rotational positions. The handle and/or the shaft may be biased to return the shaft and the handle to the first position after momentary rotation to the first or second rotational positions. The electronically controlled actuator may include a pair of rotary arms, a pair of pull arms, a push arm, an auxiliary solenoid, and master solenoid. The first rotary arm may be configured such that a clockwise rotation of the first rotary arm about a pivot point causes the shaft to rotate in a counterclockwise direction to the second rotational position. The second rotary arm may be configured such that a counterclockwise rotation of the second rotary arm about a pivot point causes the shaft to rotate in a clockwise direction to the third rotational position.

In some embodiments, the pair of rotary arms may rotate the shaft by contacting a shaft arm that is directly coupled to the shaft, rather than directly rotating the shaft. The shaft arm may include a contact surface for the rotary arm to provide a leveraged rotational force on the shaft itself. The pair of rotary arms may be selectively rotated about the respective pivot points by a downward force applied by a corresponding pair of pull arms. A push arm may selectively engage one of the pull arms with one of the rotary arms, while simultaneously disengaging the other pull arm from the other rotary arm.

In various embodiments, each rotary arm includes a channel and notch. The channel and notch may be cutouts in the rotary arm, such that they form a passthrough aperture. Alternatively, a channel and notch may be formed in a surface of each of the rotary arms without extending through an opposing surface of each of the rotary arms. The push arm may selectively push a coupling portion of one of the pull arms into the notch of one of the rotary arms (to engage the rotary arm), while simultaneously pushing the coupling portion of the other pull arm into the channel of the other rotary arm (to disengage the other rotary arm). Accordingly, only one rotary arm is engaged at a time.

The auxiliary solenoid may control the push arm to selectively engage either one of the rotary arms depending on whether a clockwise or counterclockwise rotation is desired. A master solenoid may exert a downward force on the two pull arms. The pull arm that is coupled within the notch of the rotary arm (engaged) will force that rotary arm to rotate about the pivot point. The pull arm that is coupled within the channel of the rotary arm (disengaged) will not cause the rotary arm to rotate. Rather, the coupling portion of the disengaged pull arm will translate or slide within the channel of the disengaged rotary arm.

The master solenoid may be a linear solenoid that, when energized, begins a descendant linear trajectory that causes the pull arms to descend. Once the solenoid is de-energized, the unit will return back to its initial position (normal) by internal spring action (or via another biasing force).

The embodiments of the disclosure can be further understood by reference to the drawings, wherein like parts are designated by like numerals throughout. The components of the disclosed embodiments, as generally described and illustrated in the figures herein, could be arranged and designed in a wide variety of different configurations. Thus, the following description of the embodiments of the systems and methods of the disclosure is not intended to limit the scope of the disclosure, as claimed, but is merely representative of possible embodiments.

It is particularly appreciated that many of the components could be resized, reshaped, lengthened, shortened, etc. It is also appreciated that a wide variety of connections, coupling, and fasteners could be utilized in addition to or as alternatives to those shown in the figures. In fact, many possible options are not explicitly illustrated to avoid obscuring other aspects of the illustrated embodiments. The various components described herein may be manufactured using a wide variety of metals, plastics, woods, and other materials known to be useful in manufacturing.

The phrases "connected to," "coupled to," and "in communication with" refer to any form of interaction between two or more components, including mechanical, electrical, magnetic, and electromagnetic interaction, depending on the context. Two components may be connected to each other, even though they are not in direct contact with each other, and even though there may be intermediary devices between the two components.

One or more of the described systems and methods may be implemented, monitored, and/or controlled by an intelligent electronic device (IED). As used herein, the term "IED" may refer to any microprocessor-based device that monitors, controls, automates, and/or protects monitored equipment within a system. Such devices may include, for example, remote terminal units, differential relays, distance relays, directional relays, feeder relays, overcurrent relays, voltage regulator controls, voltage relays, breaker failure relays, generator relays, motor relays, automation controllers, bay controllers, meters, recloser controls, communications processors, computing platforms, programmable logic controllers (PLCs), programmable automation controllers, input and output modules, motor drives, and the like.

IEDs may be connected to a network, and communication on the network may be facilitated by networking devices including, but not limited to, multiplexers, routers, hubs, gateways, firewalls, and switches. Furthermore, networking and communication devices may be incorporated in an IED or be in communication with an IED. The term "IED" may be used interchangeably to describe an individual IED or a system comprising multiple IEDs.

Specifically, an electronically controlled actuator for a momentary contact switch may be embodied within an IED, report data to an IED, or be controlled by an IED. For example, an IED may transmit a signal to a data port of the electronically controlled actuator to cause the momentary contact switch to rotate clockwise or counterclockwise to trip or close a circuit breaker. Remote actuation of the momentary contact switch may replace or augment manual operability of the momentary contact switch by, for example, a rotatable handle.

FIG. 1A illustrates an example of a front panel 100 of a momentary contact switch with a handle 120 in a trip position.

FIG. 1B illustrates the front panel 100 of the momentary contact switch of FIG. 1A with the handle 120 in a default, normal position.

FIG. 1C illustrates the front panel 100 of the momentary contact switch of FIG. 1A with the handle 120 in a close position.

Figure 2B:
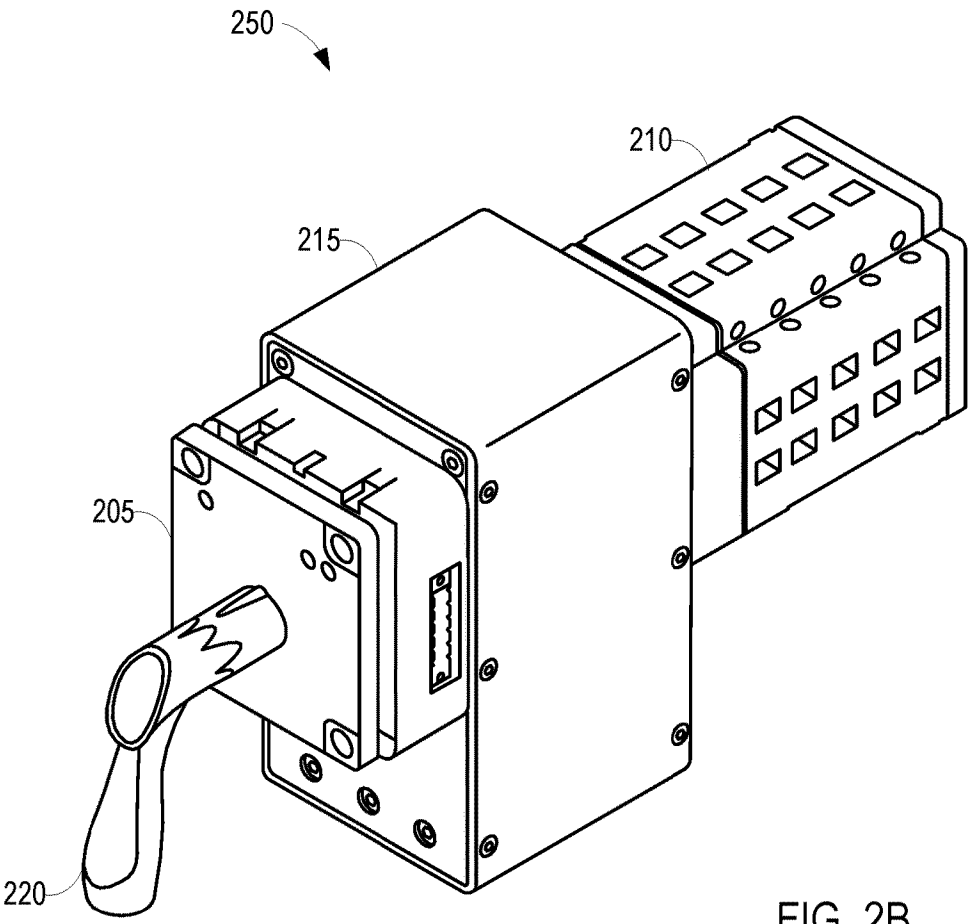
FIG. 2B illustrates an example of a momentary contact switch that is both manually and electronically operable.
Figure 2A:
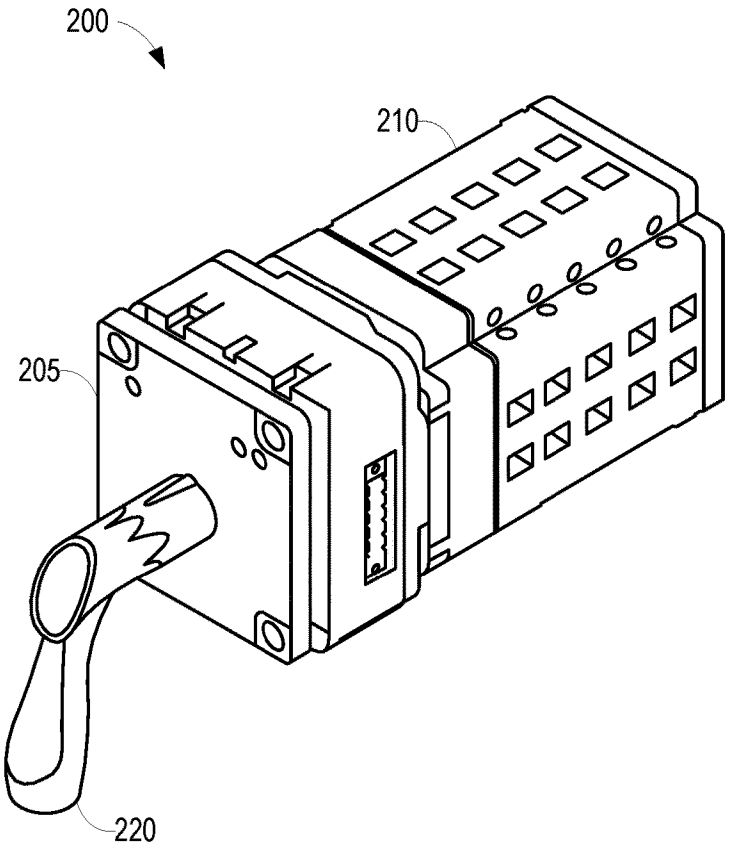
FIG. 2A illustrates an example of a manually operable momentary contact switch.

FIG. 2A illustrates an example of a manually operable momentary contact switch 200. The momentary contact switch 200 includes a front panel 205 with a manually operable handle 220. The handle 220 may be coupled to a shaft that is connected to mechanical and/or electrical switch components in the switch body 210. The switch body 210 may include any of a wide variety of mechanical and/or electrical switch components that are mechanically actuated based on a rotation of the shaft by the handle 220.

The systems and methods described herein relate to rotation of a shaft associated with an electromechanical switch housed within the switch body 210. The specific components of the electromechanical switch may be adapted for a particular application and are not described in detail herein to avoid obscuring the various embodiments of this disclosure.

FIG. 2B illustrates an example of a momentary contact switch 250 that is both manually and electronically operable. A manually operable handle 220 on the front panel 205 may be used to manually rotate a shaft of the electromechanical switch housed within the switch body 210. An electronically controlled actuator 215 positioned between the front panel 205 and the switch body 210 allows for electronic actuation of the momentary contact switch 200. Specifically, an electronic signal can be transmitted to the electronically controlled actuator 215 to rotate the shaft from a normal or default position to a clockwise or counterclockwise position. In some embodiments, a separate signal is transmitted to return the shaft to the normal or default position. In other embodiments, one or more mechanical bias members (e.g., springs, shape memory metals, etc.) exert a direct or indirect rotational force on the shaft to return the shaft to the default or normal position.

Figure 3A:
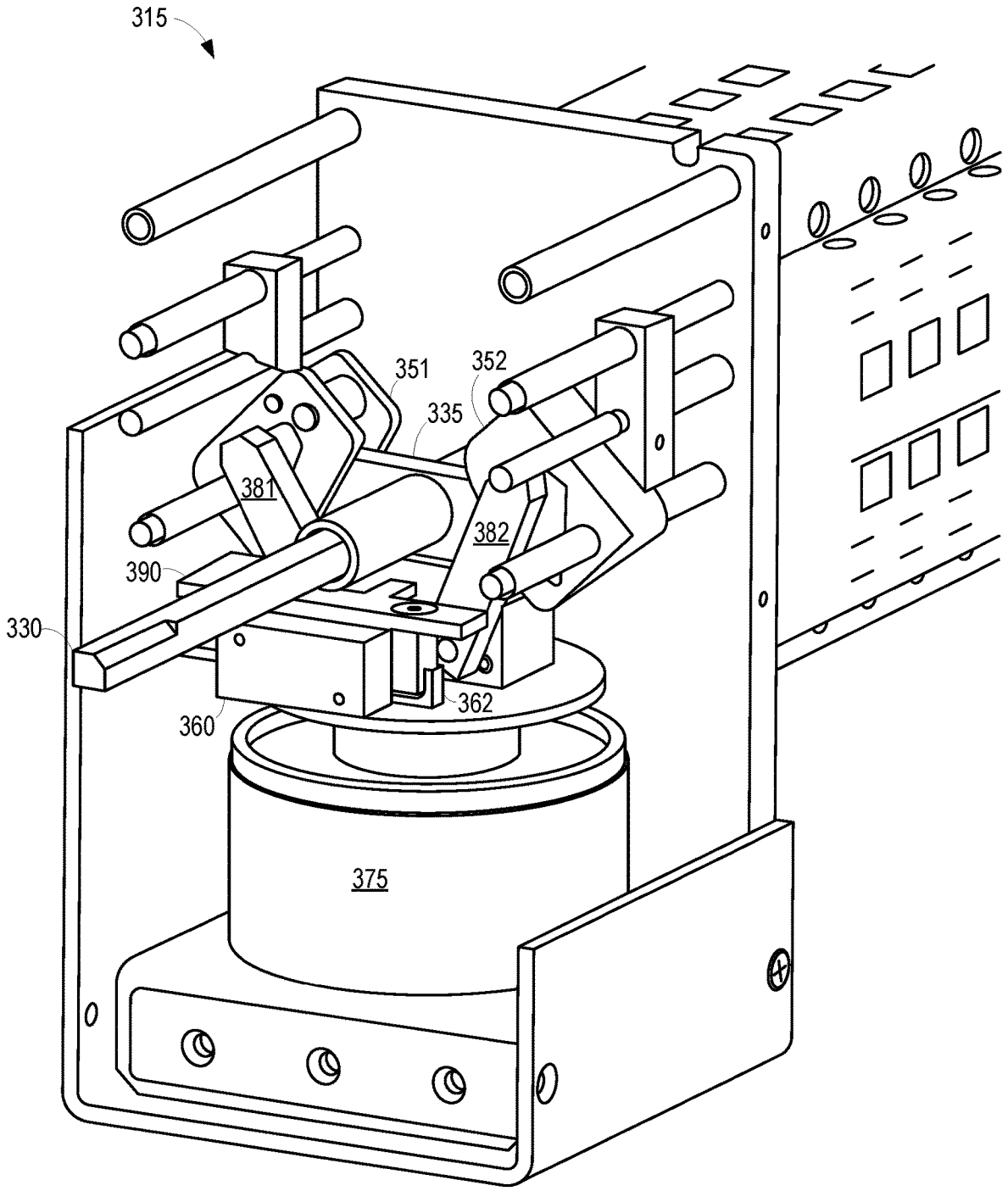
FIG. 3A illustrates a perspective view of internal components of an electronic actuation system for a momentary contact switch, according to one embodiment.

FIG. 3A illustrates a perspective view of internal components of an electronic actuation system 315 for a momentary contact switch, according to one embodiment. The illustrated embodiment allows for electronic (e.g., remote) rotation of the shaft 330 connected to the electromechanical components of the momentary contact switch. As illustrated, the electronic actuation system 315 includes a master solenoid 375 embodied as a linear solenoid. The master solenoid 375 is connected to pull arms 381 and 382. In response to an actuation signal, the master solenoid 375 extends downward and "pulls" the pull arms 381 and 382 downward.

An auxiliary solenoid 360 also embodied as a linear solenoid in the illustrated embodiment, includes a solenoid arm 362 that can be extended and retracted to move a push arm 390 left and right. With the solenoid arm 362 in the retracted position (as illustrated in FIG. 3A), the push arm 390 is moved to the left. In some embodiments, the push arm 390 may forcefully disengage the left pull arm 381 from the left rotary arm 351. In other embodiments, when the push arm 390 is disengaged the left pull arm 381 and/or the right pull arm 382 may return to an initial position (as illustrated) by spring action or other biasing force. In either embodiment, a coupling portion (e.g., a pin, bolt, shaft, or the like) of the left pull arm 381 is positioned within a channel of the left rotary arm 351 and the right pull arm 382 is engaged with the right rotary arm 352 as described below.

Along with the disengagement of the left pull arm 381, the retracted solenoid arm 362 and left movement of the push arm 390 may forcefully engage the right pull arm 382 with the right rotary arm 352. In other embodiments, as noted above, a spring or other biasing member may cause the right pull arm 382 to engage the right rotary arm 352. In either embodiment, a coupling portion of the right pull arm 382 is positioned within a notch of the right rotary arm 352. When the master solenoid 375 is actuated, the pull arms 381 and 382 descend (i.e., are pulled down) with the master solenoid 375. With the left pull arm 381 disengaged, the coupling portion of the left pull arm 381 descends within the channel of the left rotary arm 351 such that the left rotary arm 351 does not rotate. In contrast, with the right pull arm 382 engaged within the notch of the right rotary arm 352, the right rotary arm 352 will rotate counterclockwise about a pivot point as the right pull arm 382 descends. As the right rotary arm 352 rotates, it will contact the shaft arm 335 coupled to the shaft 330 and cause the shaft 330 to rotate clockwise.

Figure 3B:
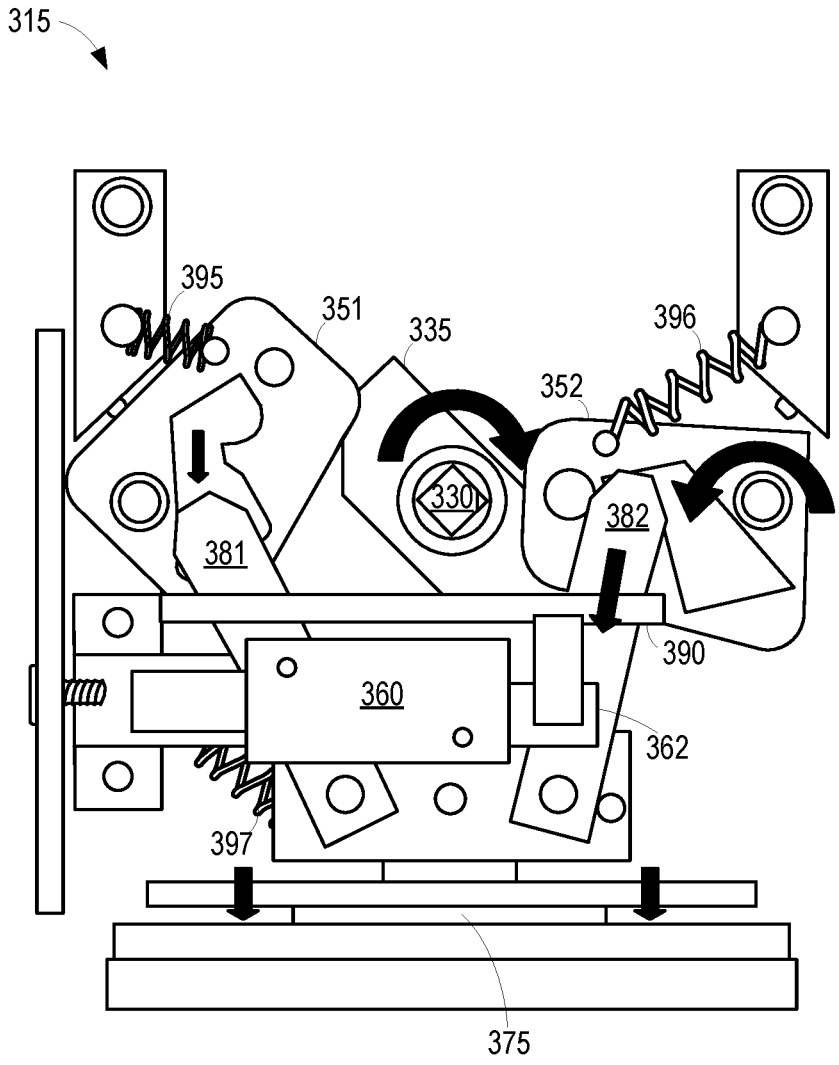
FIG. 3B illustrates the electronic actuation system of FIG. 3A with the master solenoid actuated to pull both pull arms down and rotate the right rotary arm.

FIG. 3B illustrates the electronic actuation system 315 of FIG. 3A with the master solenoid 375 actuated to pull both pull arms 381 and 382 downward. As illustrated by the bold force arrows, the left pull arm 381 translates or slides downward within the channel of the left rotary arm 351 without causing the left rotary arm 351 to rotate. The right pull arm 382 descends and engages the notch of the right rotary arm 352 and causes the right rotary arm 352 to rotate counterclockwise. The right rotary arm 352 contacts the shaft arm 335 and causes the shaft 330 to rotate clockwise.

One or more mechanical biases may return the shaft 330 to the unrotated state. Mechanical biases 395, 396 and/or 397 may provide a mechanical bias to return pull arms 381 and 382 and/or the rotary arms 351 and 352 to the unrotated, default position. For instance, the spring bias 396 is shown extended in FIG. 3B due to the rotation of the right rotary arm 352. Similarly, spring bias 397 is extended due the vertical descent of the master solenoid 375.

Figure 3C:
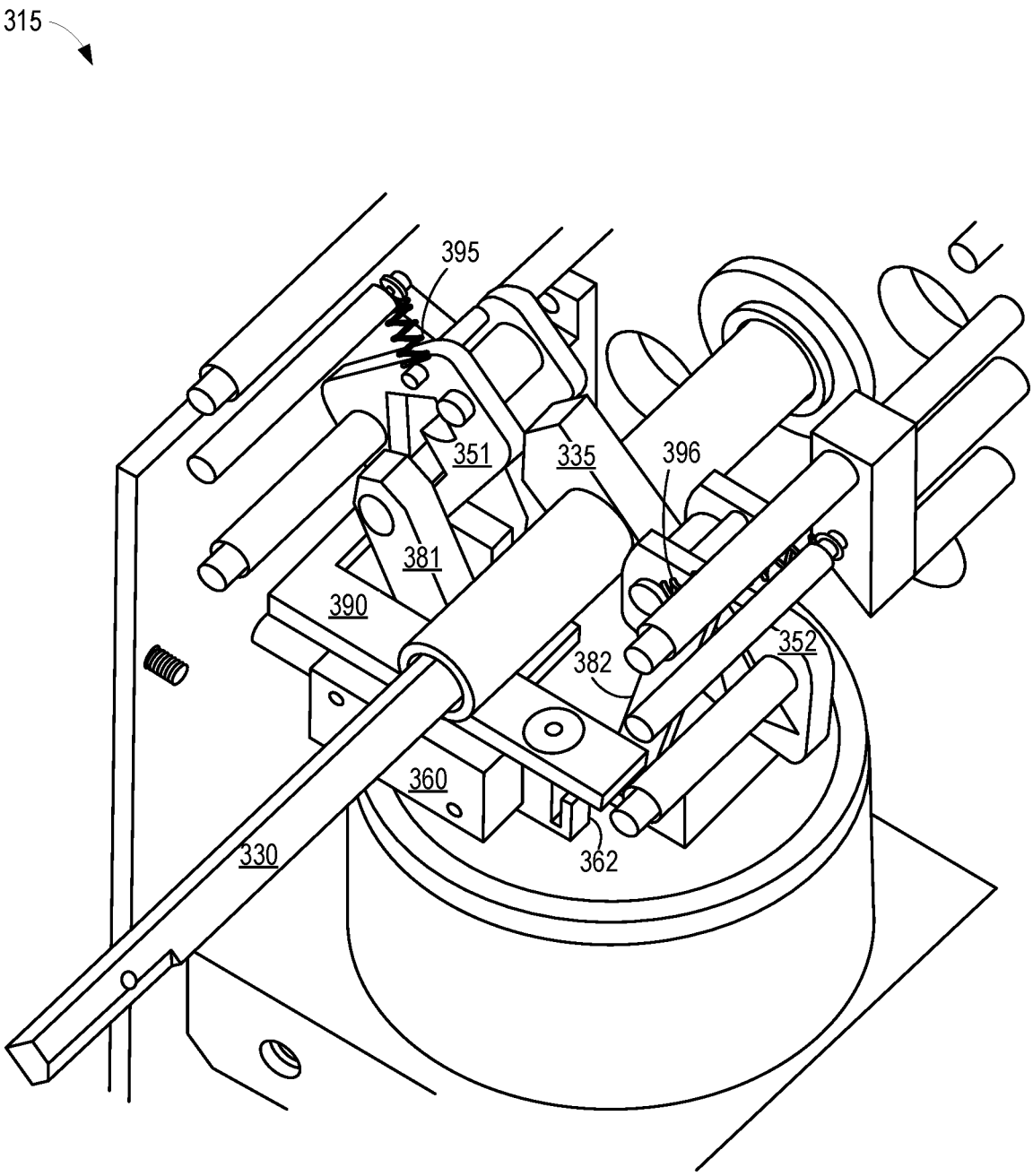
FIG. 3C illustrates another perspective view of the electronic actuation system with the shaft rotated clockwise by the rotation of the right rotary arm.

FIG. 3C illustrates a perspective view of the electronic actuation system 315 of FIG. 3A with the shaft 330 rotated clockwise by the rotation of the right rotary arm 352. As illustrated, the shaft arm 335 is contacted by a passthrough pin in the right rotary arm 352. The left side of the shaft arm 335 rotates free of the passthrough pin in the left rotary arm 351.

Figure 4A:
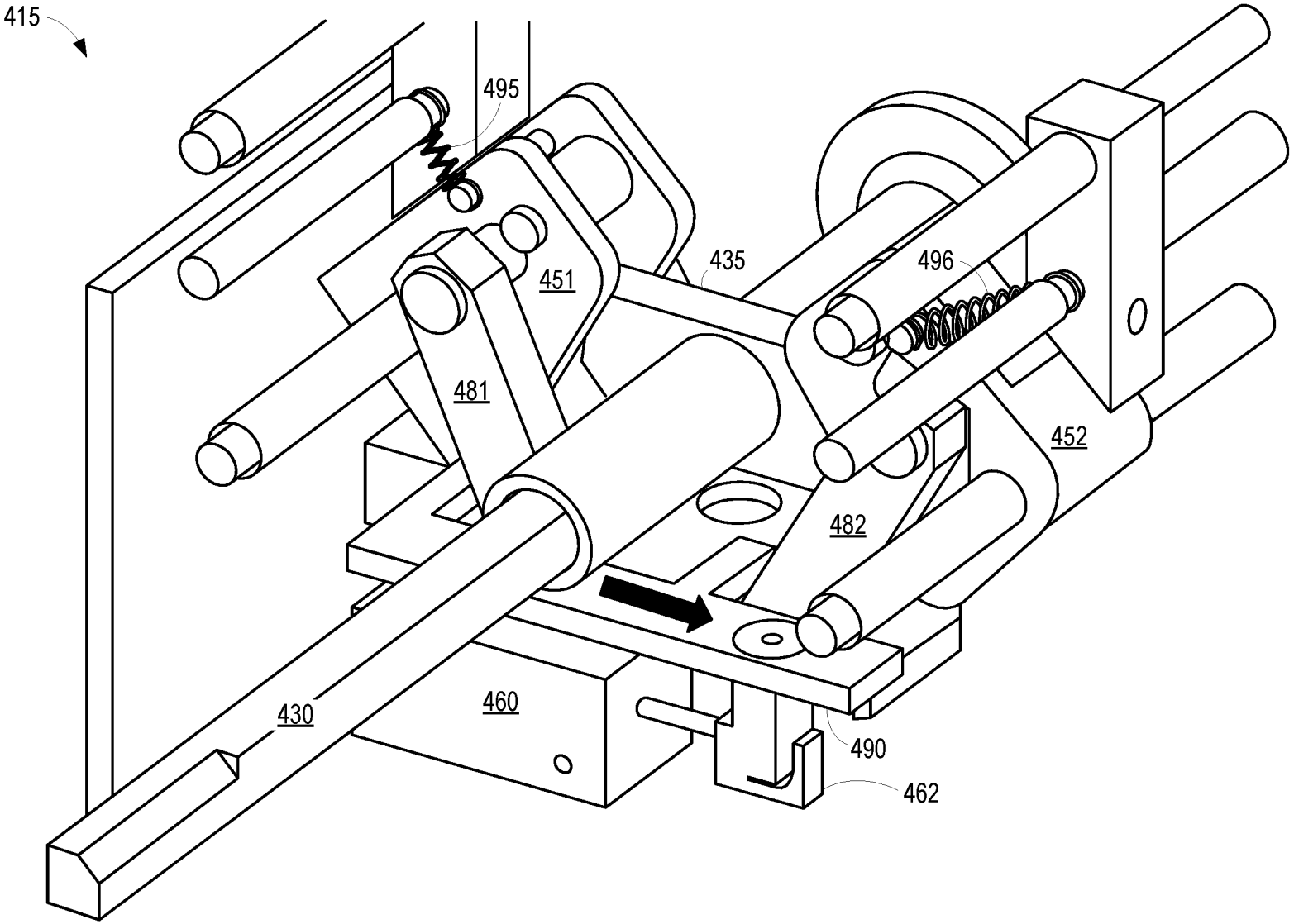
FIG. 4A illustrates an example of an electronic actuation system for a momentary contact switch with a push arm extended by an auxiliary solenoid to engage the left pull arm with the left rotary arm.

FIG. 4A illustrates an example of an electronic actuation system 415 for a momentary contact switch. As illustrated, the solenoid arm 462 extends when the auxiliary solenoid 460 is energized to translate the push arm 490 to the right. With the push arm 490 shifted to the right, the right pull arm 482 is disengaged from the right rotary arm 452. That is, the right pull arm 482 is shifted to the right such that the coupling portion of the right pull arm 482 is shifted into the channel of the right rotary arm 452. In contrast, the left pull arm 481 is engaged with the left rotary arm 451 by shifting the coupling portion of the left pull arm 481 into the notch of the left rotary arm 451.

Figure 4C:
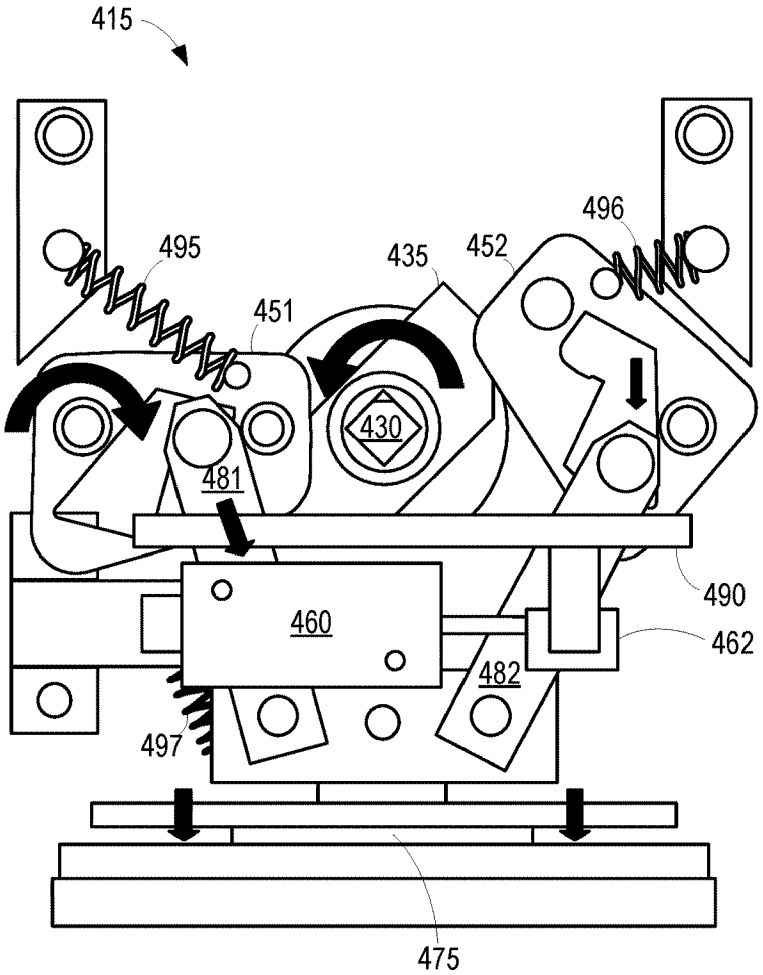
FIG. 4C illustrates the electronic actuation system of FIG. 4A with the master solenoid actuated to pull both pull arms down and rotate the left rotary arm.
Figure 4B:
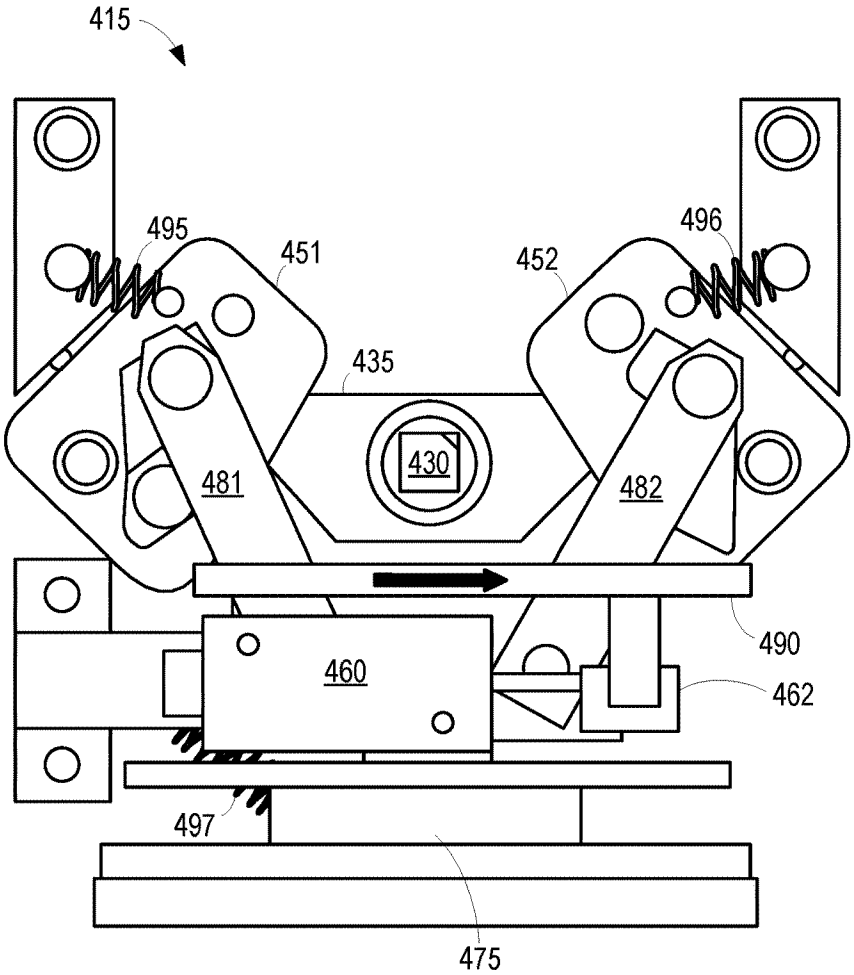
FIG. 4B illustrates the electronic actuation system of FIG. 4A with the push arm extended to engage the left pull arm with the left rotary arm and disengage the right pull arm from the right rotary arm.

FIG. 4B illustrates the electronic actuation system 415 of FIG. 4A with the solenoid arm 462 extended to shift the push arm 490 to the right. The push arm 490 shifts the pull arms 481 and 482 to the right as well, causing the left pull arm 481 to engage the notch in the left rotary arm 451 and the right pull arm 482 to disengage from the notch in the right rotary arm 452 into the channel of the right rotary arm 452.

FIG. 4C illustrates the electronic actuation system 415 of FIG. 4A with the master solenoid 475 actuated to pull both pull arms 481 and 482 down and rotate the left rotary arm 451 clockwise. The left pull arm 481 is engaged in the notch of the left rotary arm 451 to cause the left rotary arm 451 to rotate as the left pull arm 481 is pulled downward by the master solenoid 475. The left rotary arm 451 contacts the shaft arm 435 and causes it and the connected shaft 430 to rotate counterclockwise.

As previously described, biasing members may bias, directly or indirectly, the shaft 430 back to the unrotated position. Biasing members, such as biasing springs 495, 496, and 497, bias rotary arms 451 and 452 back to the unrotated state and pull arms 481 and 482 back to the un-descended state.

In the forgoing embodiments, the auxiliary solenoid 460 and the master solenoid 475 are described and illustrated as linear solenoids. In alternative embodiments, the auxiliary solenoid and/or master solenoid may be embodied as a rotary solenoid and/or utilize any of a wide variety of solenoid technologies, including but not limited to hydraulic, electromechanical, pneumatic, and inductive technologies.

Figure 4D:
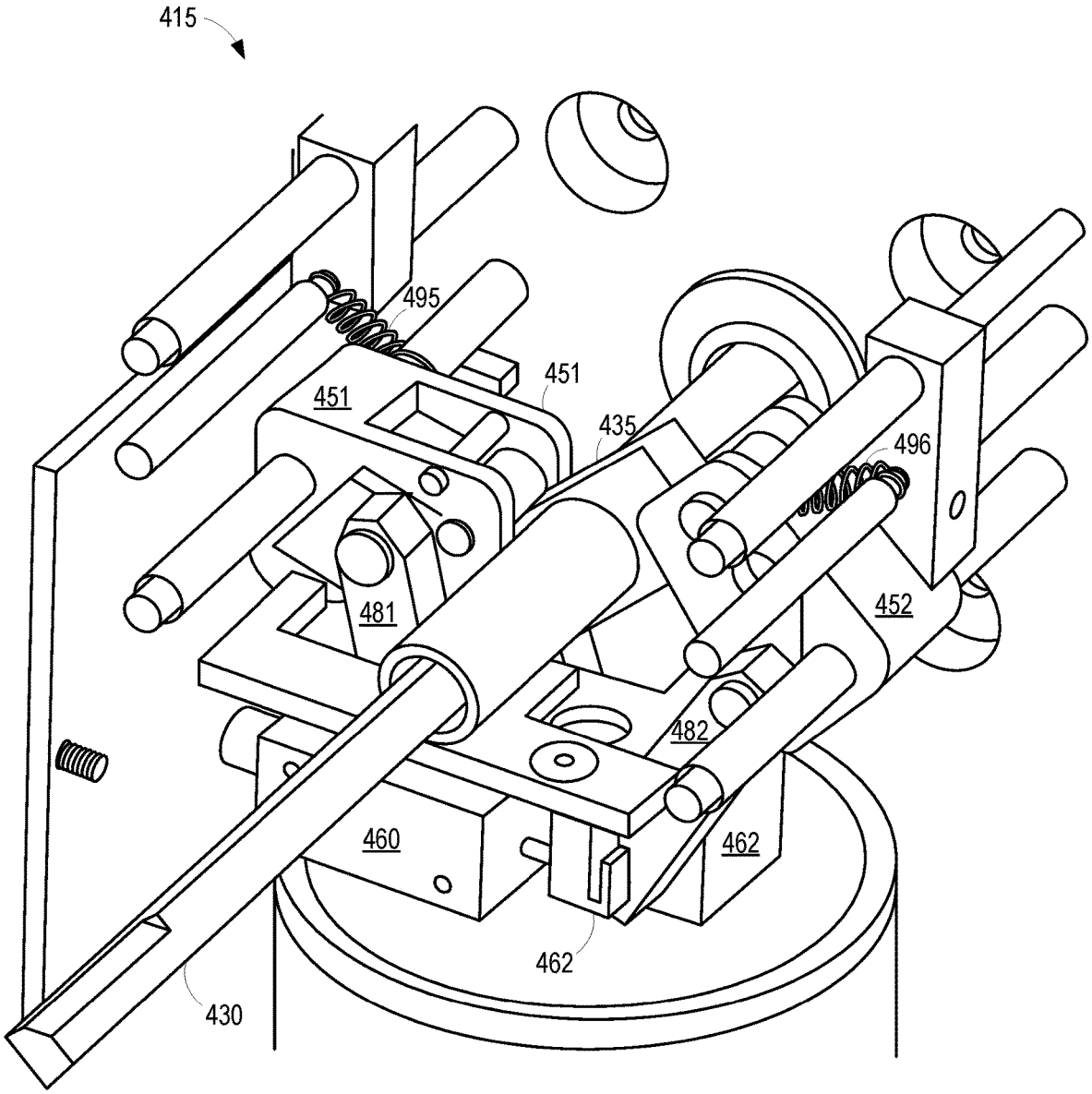
FIG. 4D illustrates a perspective view of the electronic actuation system of FIG. 4A with the shaft rotated counterclockwise by the rotation of the left rotary arm.

FIG. 4D illustrates a perspective view of the electronic actuation system 415 of FIG. 4A with the shaft 430 rotated counterclockwise by the rotation of the left rotary arm 451. As illustrated, the left rotary arm 451 contacts the shaft arm 435 as it rotates clockwise and causes the shaft 430 to rotate counterclockwise. Bias spring 495 may cause left rotary arm 451 to return to the unrotated state after the momentary rotation of the shaft 430.

Specific embodiments and applications of the disclosure are described above and illustrated in the figures. It is, however, understood that many adaptations and modifications can be made to the precise configurations and components detailed above. In some cases, well-known features, structures, or operations are not shown or described in detail. Furthermore, the described features, structures, or operations may be combined in any suitable manner in one or more embodiments. It is also appreciated that the components of the embodiments as generally described and illustrated in the figures herein could be arranged and designed in a wide variety of different configurations. Thus, all feasible permutations and combinations of embodiments are contemplated.

In the description above, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims are hereby expressly incorporated into this Detailed Description, with each claim standing on its own as a separate embodiment. This disclosure includes all permutations and combinations of the independent claims with their dependent claims.

It will be apparent to those having skill in the art that changes may be made to the details of the above-described embodiments without departing from the underlying principles of the invention.

What is claimed is:

1. An electronic actuation system for a switch, comprising:

a shaft configured to rotate between a first rotational position and a second rotational position, wherein each of the first and second rotational positions of the shaft correspond to unique mechanical states of the switch;

a manually operable handle coupled to the shaft to allow for manual rotation of the shaft between the first rotational position and the second rotational position;

a first rotary arm that, when rotated, causes the shaft to rotate from the first rotational position to the second rotational position;

a pull arm selectively engageable with the first rotary arm;

a push arm moveable between a first push position that engages the pull arm with the first rotary arm and a second push position that disengages the pull arm from the first rotary arm;

an auxiliary solenoid electronically actuatable to move the push arm between the first push position and the second push position; and a master solenoid electronically actuatable to move the pull arm between an unactuated position and an actuated position, wherein, when the pull arm is electronically actuated to move to the actuated position and the pull arm is engaged, the pull arm causes the first rotary arm to rotate, which rotates the shaft from the first rotational position to the second rotational position.

2. The system of claim 1, wherein the unique mechanical states of the switch correspond to an electrically open state and an electrically closed state.

3. The system of claim 1, comprising a second rotary arm, wherein each of the first and second rotary arms includes a channel and a notch.

4. The system of claim 3, wherein, with the pull arm engaged, the pull arm is coupled to the first rotary arm within the notch of the first rotary arm, such that movement of the pull arm to the actuated position causes the pull arm to exert a force on the notch of the first rotary arm to cause the first rotary arm to rotate about a pivot point.

5. The system of claim 3, wherein, with the pull arm disengaged, the pull arm is coupled to the first rotary arm within the channel of the first rotary arm, such that movement of the pull arm to the actuated position causes the first pull arm to translate within the channel of the first rotary arm without causing the first rotary arm to rotate.

6. An electronic actuation system for a switch, comprising:

a first rotary arm that, when rotated, causes a shaft of a switch to rotate from a first rotational position to a second, counterclockwise rotational position;

a second rotary arm that, when rotated, causes the shaft to rotate from the first rotational position to a third, clockwise rotational position, wherein each of the first, second, and third rotational positions of the shaft correspond to unique mechanical states of the switch;

a first pull arm selectively engageable with the first rotary arm;

a second pull arm selectively engageable with the second rotary arm;

a push arm moveable between a first push position and a second push position, wherein, in the first push position, the push arm selectively engages the first pull arm with the first rotary arm and disengages the second pull arm from the second rotary arm, and wherein, in the second push position, the push arm selectively engages the second pull arm with the second rotary arm and disengages the first pull arm from the first rotary arm;

an auxiliary solenoid electronically actuatable to move the push arm between the first push position and the second push position; and a master solenoid electronically actuatable to move the first and second pull arms between an unactuated position and an actuated position, wherein, with the first and second pull arms in the actuated position, the engaged pull arm causes the corresponding rotary arm to rotate, which rotates the shaft from the first rotational position to one of the second and third rotational positions, depending on which of the first and second pull arms is engaged by the push arm.

7. The system of claim 6, further comprising a shaft arm coupled to the shaft, wherein the first and second rotary arms are configured to contact the shaft arm when they are rotated to thereby rotate the shaft.

8. The system of claim 6, wherein each of the first and second rotary arms are configured to rotate about a pivot point as a corresponding engaged pull arm is moved from the unactuated position to the actuated position.

9. The system of claim 6, wherein the switch comprises a circuit breaker and the unique mechanical states of the circuit breaker correspond to a trip function of the circuit breaker, a normal state of the circuit breaker, and a close function of the circuit breaker.

10. The system of claim 6, wherein each of the first and second rotary arms includes a channel and a notch.

11. The system of claim 6, further comprising a biasing member to bias the first and second pull arms to the unactuated position, such that the first and second pull arms are returned to the unactuated position following an electronic actuation of the second linear solenoid.

12. The system of claim 10, wherein, with the first pull arm engaged, the first pull arm is coupled to the first rotary arm within the notch of the first rotary arm and the second pull arm is coupled to the second rotary arm within the groove of the second rotary arm, such that movement of the first and second pull arms to the actuated position causes:

the first pull arm to exert a force on the notch of the first rotary arm to cause the first rotary arm to rotate about a pivot point, and the second pull arm to translate within the channel of the second rotary arm without causing the second rotary arm to rotate.

13. The system of claim 10, wherein, with the second pull arm engaged, the second pull arm is coupled to the second rotary arm within the notch of the second rotary arm and the first pull arm is coupled to the first rotary arm within the groove of the first rotary arm, such that movement of the first and second pull arms to the actuated position causes:

the second pull arm to exert a force on the notch of the second rotary arm to cause the second rotary arm to rotate about a pivot point, and the first pull arm to translate within the channel of the first rotary arm without causing the first rotary arm to rotate.

14. The system of claim 6, further comprising:

a first biasing member to bias the first rotary arm to an unrotated state, such that the first rotary arm is returned to the unrotated state following an electronic actuation of the second linear solenoid with the first pull arm engaged with the first rotary arm; and a second biasing member to bias the second rotary arm to an unrotated state, such that the second rotary arm is returned to the unrotated state following an electronic actuation of the second linear solenoid with the second pull arm engaged with the second rotary arm.

15. The system of claim 6, wherein each of the auxiliary solenoid and the master solenoid comprises a linear solenoid.

16. The system of claim 6, wherein the electronic actuation system is configured to be inserted between electrical components of the switch and a manually operable handle of the switch, wherein the manually operable handle is coupled to the shaft to allow for manual rotation of the shaft between the first, second, and third rotational positions.

17. The system of claim 6, further comprising a data input port to receive control signals to operate each of the auxiliary solenoid and the master solenoid.

18. A momentary contact switch for a circuit breaker, comprising:

a shaft that is rotatable to first, second, and third rotational positions corresponding to normal, trip, and close positions, respectively, of the circuit breaker;

a manually operable handle coupled to the shaft to allow for manual rotation of the shaft between the first, second, and third rotational positions;

a first rotary arm that, when rotated, causes the shaft to rotate to the second, counterclockwise rotational position;

a second rotary arm that, when rotated, causes the shaft to rotate to the third, clockwise rotational position;

a first pull arm selectively engageable with the first rotary arm;

a second pull arm selectively engageable with the second rotary arm;

a push arm electronically moveable between a first push position that selectively engages the first pull arm with the first rotary arm, and a second push position that selectively engages the second pull arm with the second rotary arm;

an auxiliary solenoid electronically actuatable to move the push arm between the first push position and the second push position; and a master solenoid electronically actuatable to move the first and second pull arms between an unactuated position and an actuated position, wherein, with the first and second pull arms in the actuated position, the engaged pull arm causes the corresponding rotary arm to rotate, which rotates the shaft to one of the second and third positions based on which of the first and second pull arms is engaged by the push arm.

19. The switch of claim 18, further comprising a shaft arm coupled to the shaft, wherein the first and second rotary arms are configured to contact the shaft arm when they are rotated to thereby rotate the shaft.

20. The switch of claim 18, wherein each of the first and second rotary arms are configured to rotate about a pivot point as a corresponding engaged pull arm is moved from the unactuated position to the actuated position.

21. The switch of claim 18, wherein, with the first pull arm engaged, the first pull arm is coupled to the first rotary arm within a notch of the first rotary arm and the second pull arm is coupled to the second rotary arm within a groove of the second rotary arm, such that movement of the first and second pull arms to the actuated position causes:

the first pull arm to exert a force on the notch of the first rotary arm to cause the first rotary arm to rotate about a pivot point, and the second pull arm to translate within the channel of the second rotary arm without causing the second rotary arm to rotate.

22. The switch of claim 18, wherein, with the second pull arm engaged, the second pull arm is coupled to the second rotary arm within a notch of the second rotary arm and the first pull arm is coupled to the first rotary arm within a groove of the first rotary arm, such that movement of the first and second pull arms to the actuated position causes:

the second pull arm to exert a force on the notch of the second rotary arm to cause the second rotary arm to rotate about a pivot point, and the first pull arm to translate within the channel of the first rotary arm without causing the first rotary arm to rotate.

23. The switch of claim 18, further comprising at least one biasing member to rotationally bias the shaft from each of the second and third rotational positions to the first rotational position, such that the shaft is returned to the first rotational position after either of the manually operable handle or the master solenoid is used to rotate the shaft to the second or third rotational position.

* * * * *